US011254141B2

(12) United States Patent
Inoue

(10) Patent No.: US 11,254,141 B2
(45) Date of Patent: Feb. 22, 2022

(54) PRINTING SYSTEM

(71) Applicant: Brother Kogyo Kabushiki Kaisha, Nagoya (JP)

(72) Inventor: Naoki Inoue, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/669,907

(22) Filed: Oct. 31, 2019

(65) Prior Publication Data

US 2020/0130370 A1 Apr. 30, 2020

(30) Foreign Application Priority Data

Oct. 31, 2018 (JP) ..... JP2018-205973

(51) Int. Cl.
*B41J 33/16* (2006.01)
*B41J 2/325* (2006.01)

(52) U.S. Cl.
CPC ..... *B41J 2/325* (2013.01)

(58) Field of Classification Search
CPC ..... B41J 35/08; B41J 33/36; B41J 17/30
See application file for complete search history.

(56) References Cited

U.S. PATENT DOCUMENTS 5,294,203 A * 3/1994 Williams ..... B41J 33/36 400/223
6,315,471 B1 * 11/2001 Hsieh ..... B41J 35/08 347/172
8,937,634 B2 1/2015 Morgan et al.
2007/0231041 A1 * 10/2007 Ueda ..... B41J 17/30 400/234
2011/0229239 A1 9/2011 Lakin et al.

FOREIGN PATENT DOCUMENTS

| | | | |
|---|---|---|---|
| CN | 102834272 | A | 12/2012 |
| FR | 2783460 | A1 | 3/2000 |
| GB | 2294907 | A | 5/1996 |
| JP | S63-290787 | A | 11/1988 |

(Continued)

OTHER PUBLICATIONS

Jun. 18, 2020—(EP) Extended Search Report—App 19205698.4.

(Continued)

*Primary Examiner* — Lam S Nguyen
(74) *Attorney, Agent, or Firm* — Banner & Witcoff, Ltd.

(57) ABSTRACT

A printing system includes: a control unit; and a printing device including: a supply unit configured to be attached with a supply roll configured by an ink ribbon; a winding unit configured to be attached with a winding roll for winding the ink ribbon fed out from the supply roll; a ribbon motor configured to rotationally drive at least one of the supply unit and the winding unit; a thermal head configured to perform printing by heating the ink ribbon transported from the supply roll toward the winding roll by driving the ribbon motor; and a head drive source configured to move the thermal head. The control unit is configured to control the ribbon motor to decrease tension of the ink ribbon when the thermal head is moved in a first direction, in which the tension of the ink ribbon increases, with the head drive source.

8 Claims, 10 Drawing Sheets

(56) References Cited

FOREIGN PATENT DOCUMENTS

| | | | |
|---|---|---|---|
| JP | H03-086577 | A | 4/1991 |
| JP | H10-044481 | A | 2/1998 |
| JP | 2001225537 | A | 8/2001 |
| JP | 2010-036425 | A | 2/2010 |
| JP | 2010047026 | A | 3/2010 |
| JP | 2013-049281 | A | 3/2013 |
| WO | 2008107648 | A1 | 9/2008 |

OTHER PUBLICATIONS

Jan. 11, 2021—(CN) Notification of First Office Action—App 201911029100.6.
Feb. 26, 2020—(EP) Partial Search Report—App 19205698.4.

* cited by examiner

PRINTING SYSTEM

CROSS-REFERENCE TO RELATED APPLICATION

This application claims priority from Japanese Patent Application No. 2018-205973 filed on Oct. 31, 2018, the entire subject matter of which is incorporated herein by reference.

TECHNICAL FIELD

This disclosure relates to a printing system.

BACKGROUND ART

A background art discloses a thermal printer. The thermal printer includes a ribbon cassette, a printer main body, and a platen roller. The ribbon cassette holds a first ribbon core around which an unused ink ribbon is wound and a second ribbon core around which the ink ribbon after being subjected to printing is wound. The ink ribbon is transported along a predetermined transport path from the first ribbon core toward the second ribbon core. The printer main body is provided with a thermal head. The thermal head is movable between an initial position and a print position. The thermal head contacts the ink ribbon as the thermal head is moved from the initial position to the print position. The thermal head brings the ink ribbon into contact with a packaging film in a predetermined contact section, and presses the ink ribbon and the packaging film against a circumferential surface of the platen roller. Printing on the packaging film is executed by heating the thermal head in this state.

When the thermal head is moved from the initial position to the print position, tension of the ink ribbon may increase. In this case, there is a possibility that the ink ribbon is cut depending on magnitude of the increasing tension of the ink ribbon. Also, there is a possibility that a motor for transporting the ink ribbon by rotating the first ribbon core and the second ribbon core is stepped out. In these cases, there is a problem that the thermal printer cannot appropriately execute a print operation.

An object of this disclosure is to provide a printing system capable of appropriately executing a print operation by suppressing an increase in tension of an ink ribbon according to movement of a thermal head.

SUMMARY

According to one aspect of this disclosure, a printing system includes: a control unit; and a printing device including: a supply unit configured to be attached with a supply roll configured by an ink ribbon; a winding unit configured to be attached with a winding roll for winding the ink ribbon fed out from the supply roll; a ribbon motor configured to rotationally drive at least one of the supply unit and the winding unit; a thermal head configured to perform printing by heating the ink ribbon transported from the supply roll toward the winding roll by driving the ribbon motor; and a head drive source configured to move the thermal head. The control unit is configured to control the ribbon motor to decrease tension of the ink ribbon when the thermal head is moved in a first direction, in which the tension of the ink ribbon increases, with the head drive source.

According to another aspect of this disclosure, a printing system, includes: a control unit; and a printing device including: a supply unit configured to be attached with a supply roll configured by an ink ribbon; a winding unit configured to be attached with a winding roll for winding the ink ribbon fed out from the supply roll; a ribbon motor configured to rotationally drive at least one of the supply unit and the winding unit; a thermal head configured to perform printing by heating the ink ribbon transported from the supply roll toward the winding roll by driving the ribbon motor; a head drive source configured to move the thermal head and include a head motor that rotates to move the thermal head; a lid capable of opening and closing an accommodation portion in which the ink ribbon is accommodated. In response to opening of the accommodation portion, the control unit is configured to control the head drive source to move the thermal head, and the control unit is configured to control to supply a current of a first value to the head motor after the moving the thermal head with the head drive source. In response to closing of the accommodation portion by the lid, the control unit is configured to control the head drive source to move the thermal head in a direction in which the tension of the ink ribbon increases, and the control unit is configured to control to supply a current of a second value to the head motor after the moving the thermal head in the direction with the head drive source. The first value is larger than the second value.

According to this disclosure, the printing system can suppress the increase in tension of the ink ribbon according to the movement of the thermal head. For that reason, the printing system can suppress cutting of the ink ribbon and step out of the ribbon motor, and thus the print operation can be appropriately executed.

DESCRIPTION OF EMBODIMENTS

Overview of Printing System 1

One embodiment of this disclosure will be described with reference to the drawings. The printing system 1 is a system for performing thermal transfer printing. The printing system 1 performs printing on a print medium P (see FIG. 5) transported by an external apparatus 8 (see FIG. 6). A specific example of the external apparatus 8 includes a packaging machine that transports a packaging material. In this case, for example, the printing system 1 is used by being incorporated into a part of a transport line on which the print medium P is transported by the packaging machine.

Figure 1:
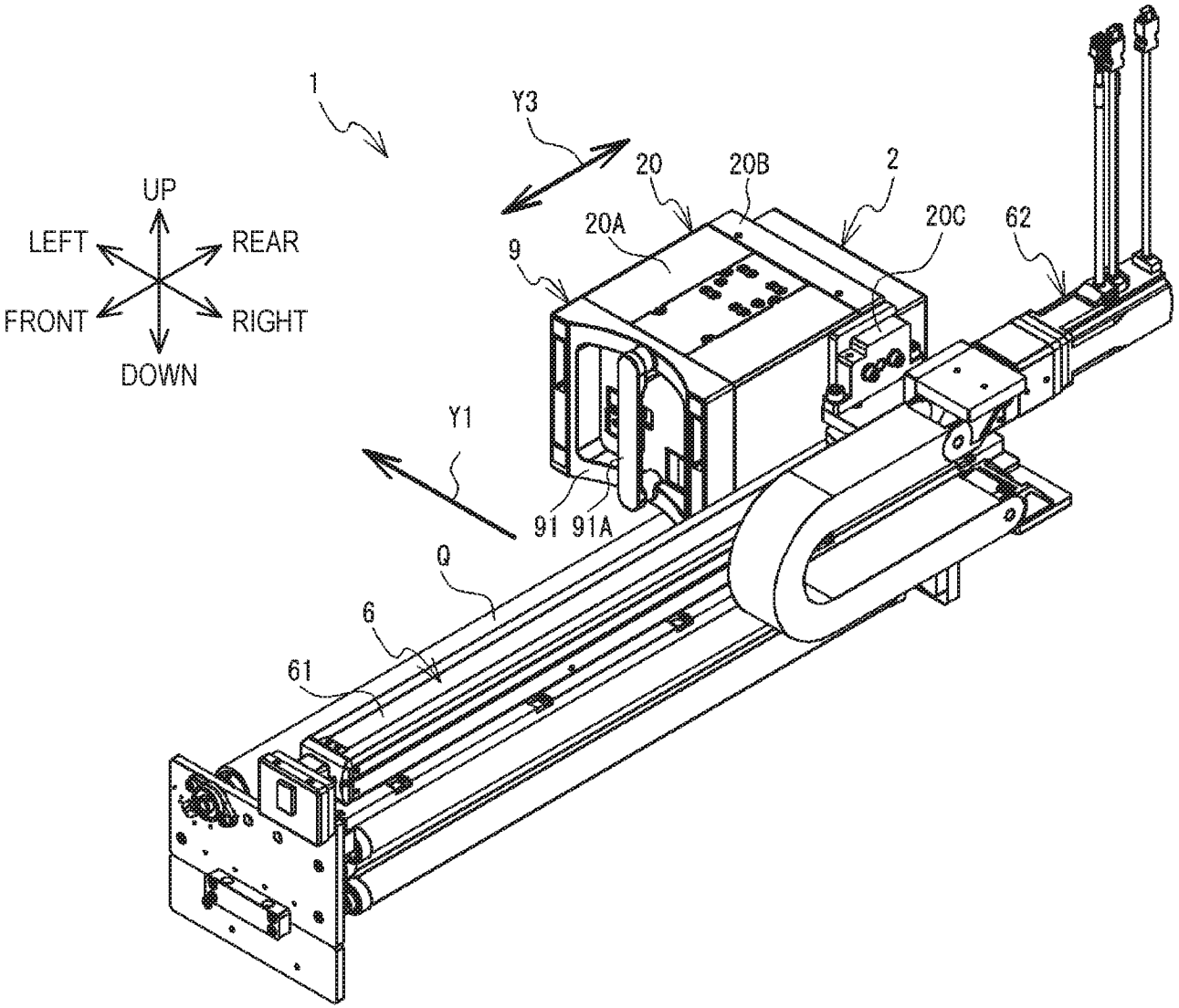
FIG. 1 is a perspective view of a printing system (in a state where a cassette is attached)

As illustrated in FIG. 1, the printing system 1 includes a printing device 2, a bracket 6, a controller 7 (see FIG. 6), and a platen roller Q. Hereinafter, in order to help understanding of the description of the drawings, the above, the below, the left, the right, the front, and the rear of each configuration included in the printing system 1 will be defined. The above, the below, the left, the right, the front, and the rear of the printing device 2 and the bracket 6 correspond to an upper side, a lower side, an obliquely upper left side, an obliquely lower right side, an obliquely lower left side, and an obliquely upper right side in FIG. 1, respectively. In FIG. 1, a transport direction of the print medium P coincides with a horizontal direction. The print medium P is transported in the left direction (in a direction of an arrow Y1) by the external apparatus 8.

Cassette 9

Figure 2:
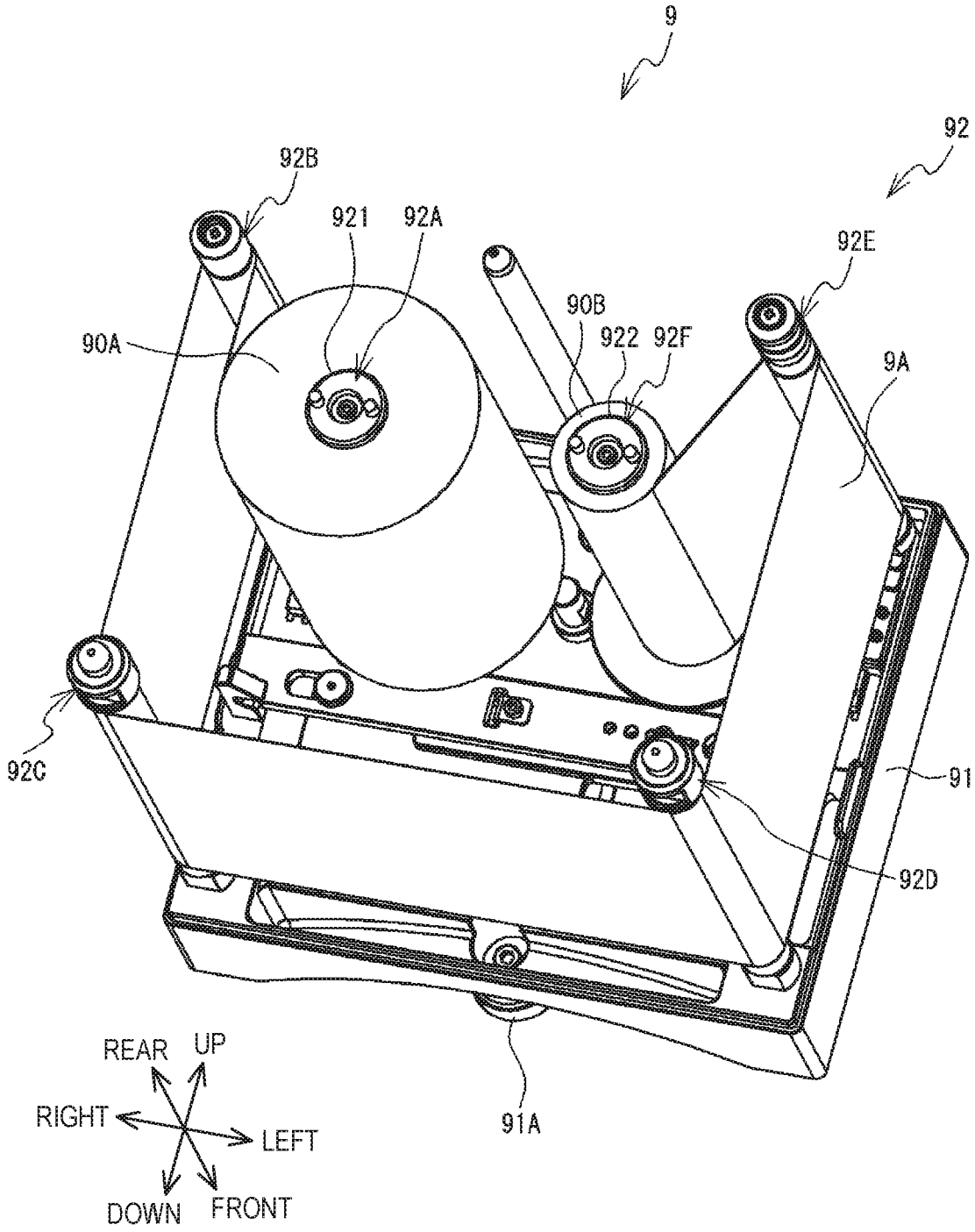
FIG. 2 is a perspective view of the cassette.

In the printing system 1, printing on the print medium P is performed in a state where the cassette 9 is attached to the printing device 2. The printing device 2 performs printing by heating an ink ribbon 9A (see FIG. 2) of the cassette 9. As illustrated in FIG. 2, the cassette 9 includes a lid 91, shafts 92A to 92F, a supply roll 90A, and a winding roll 90B. The lid 91 has a substantially square plate shape. A handle 91A is provided on the front surface of the lid 91 (see FIG. 1). The shafts 92A to 92F are spindles that are rotatable around a rotation axis extending in the front-and-rear direction. The shafts 92A to 92F extend rearward from the rear surface of the lid 91.

The shafts 92A and 92F are aligned in the horizontal direction above the center of the lid 91 in a vertical direction. A spool 921 to which one end of the ink ribbon 9A is connected is attached to the shaft 92A. A spool 922 to which the other end of the ink ribbon 9A is connected is attached to the shaft 92E In each of the spools 921 and 922, the ink ribbon 9A is wound in a roll shape. The supply roll 90A is configured by winding the ink ribbon 9A around the spool 921. The winding roll 90B is configured by winding the ink ribbon 9A around the spool 922. The ink ribbon 9A is fed out from the supply roll 90A by the printing device 2 and wound around the winding roll 90B. The shaft 92B is provided at the upper right corner of the lid 91. The shaft 92C is provided at the lower right corner of the lid 91. The shaft 92D is provided at the lower left corner of the lid 91. The shaft 92E is provided at the upper left corner of the lid 91. The ink ribbon 9A stretched between the supply roll 90A and the winding roll 90B is in contact with a part of a circumferential surface of each of the shafts 92B to 92E.

Platen Roller Q

As illustrated in FIG. 1, the platen roller Q has a cylindrical shape. The platen roller Q is rotatable around a rotation axis extending in the front-and-rear direction. The printing device 2 is disposed above the platen roller Q. The print medium P (see FIG. 5) and the ink ribbon 9A are sandwiched between the platen roller Q and a thermal head 24 (see FIG. 3) of the printing device 2. The platen roller Q contacts the print medium P transported by the external apparatus 8 (see FIG. 6) from below and presses the print medium P against the ink ribbon 9A.

Printing Device 2

Figure 3:
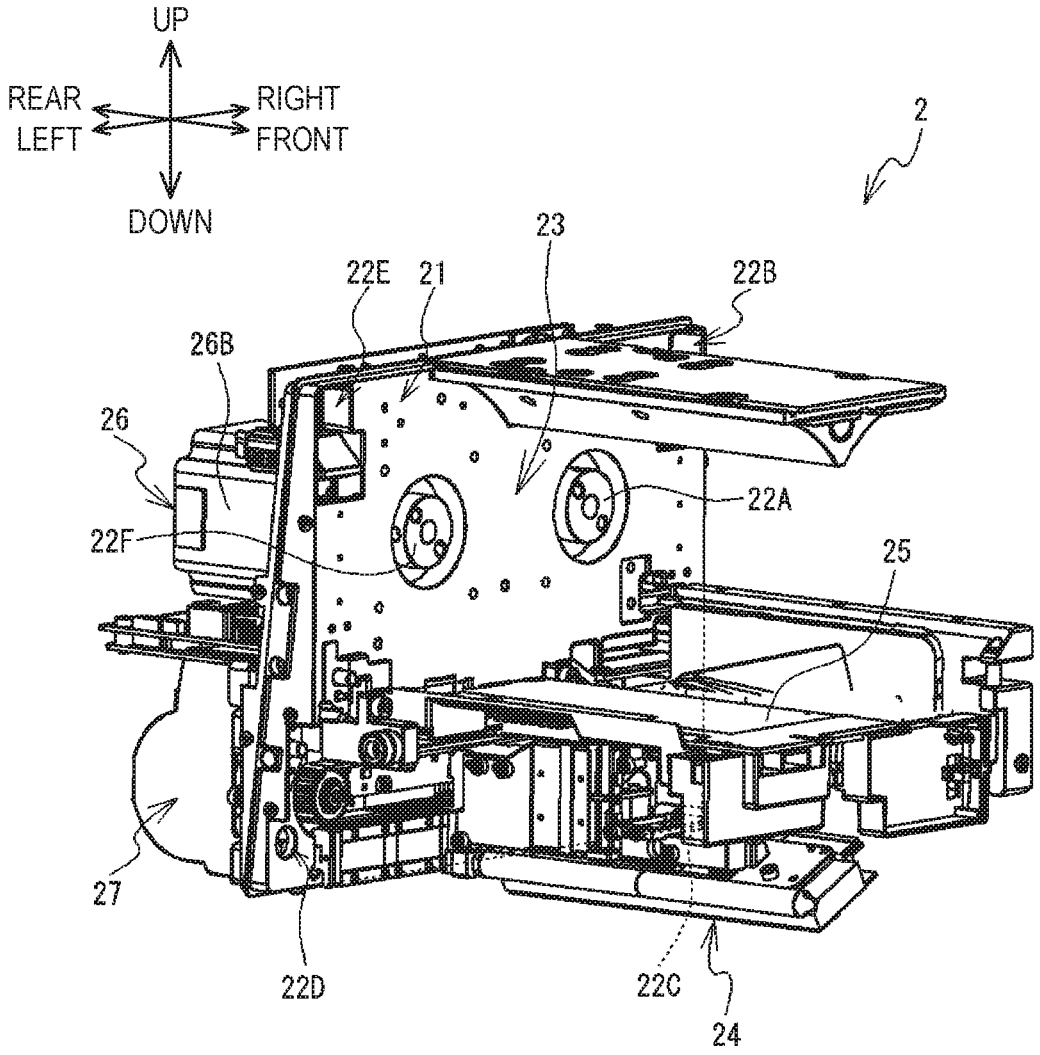
FIG. 3 is a perspective view of a printing device in a state where a casing is removed.

The printing device 2 includes a casing 20 illustrated in FIG. 1 and a base plate 21 illustrated in FIG. 3. In FIG. 3, the printing device 2 in a state where the casing 20 is removed is illustrated. As illustrated in FIG. 3, the base plate 21 has a substantially square plate shape, and is orthogonal to the front-and-rear direction. In front of the base plate 21, a supply unit 22A, attachment units 22B to 22E, a winding unit 22F, the thermal head 24, and a control board 25 are provided. In the rear of the base plate 21, a ribbon drive source 26 and a head drive source 27 are provided.

Figure 4:
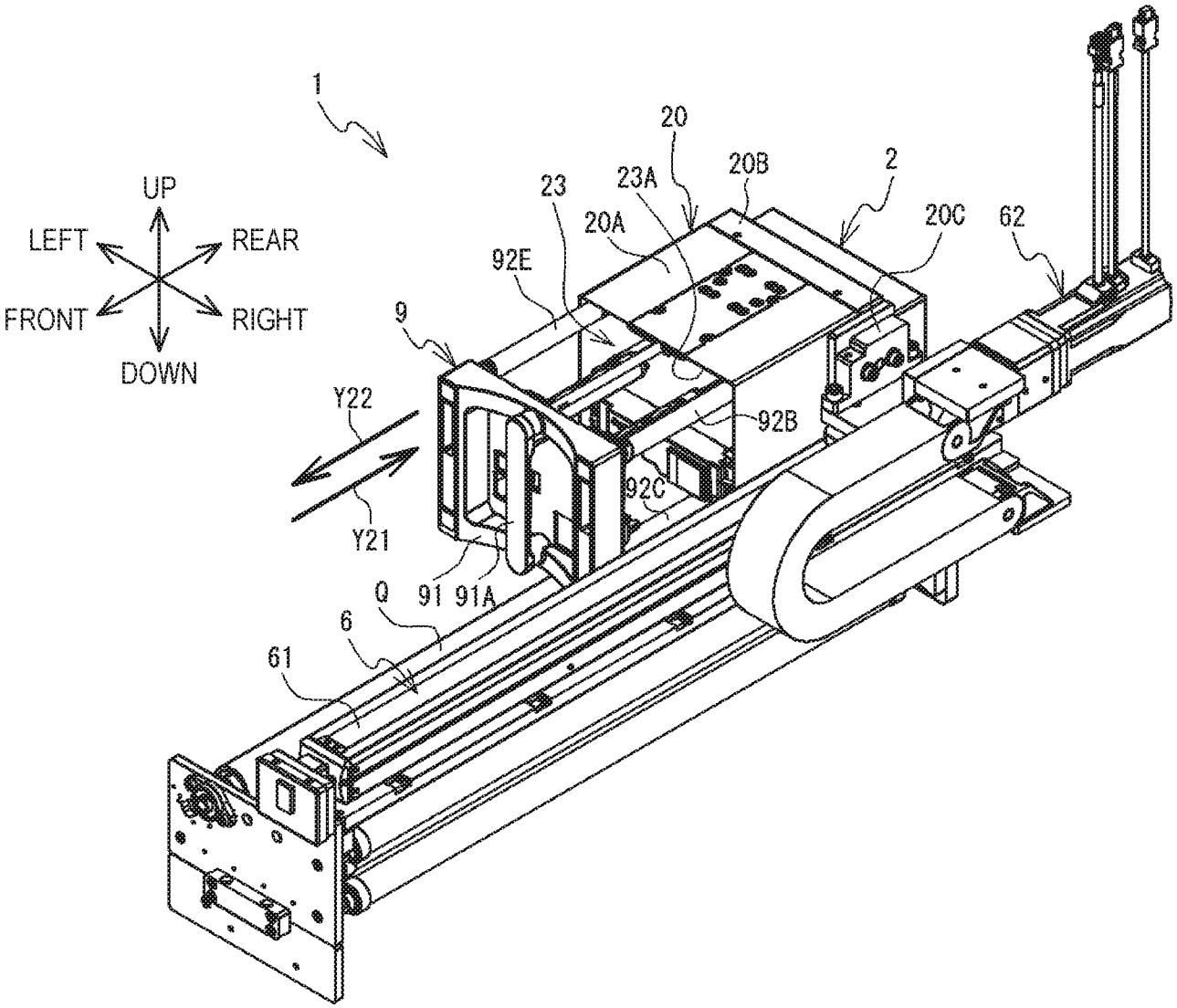
FIG. 4 is a perspective view of the printing system (in a state where the cassette is detached)

As illustrated in FIG. 1, the casing 20 has substantially rectangular parallelepiped shape. The casing 20 includes casings 20A and 20B aligned in the front-and-rear direction. The casing 20A is provided in front of the base plate 21 (see FIG. 3), and covers the supply unit 22A, the attachment units 22B to 22E, the winding unit 22F, the thermal head 24, and the control board 25 (see FIG. 3). As illustrated in FIG. 4, a front end and a lower end of the casing 20A are opened. A shape of an opening 23A at the front end of the casing 20A is substantially the same as the shape of the lid 91 of the cassette 9. A space covered by the base plate 21 and the casing 20A is referred to as an accommodation portion 23. In the accommodation portion 23, the ink ribbon 9A of the cassette 9 can be accommodated. The opening 23A communicates with the accommodation portion 23. The casing 20B is provided in the rear of the base plate 21 and covers the ribbon drive source 26 and the head drive source 27 (see FIG. 3).

The cassette 9 moves rearward (in a direction of an arrow Y21) in a state of being disposed in front of the printing device 2, and is inserted into the casing 20A through the opening 23A of the casing 20A. The ink ribbon 9A of the cassette 9 is accommodated in the accommodation portion 23. The lid 91 of the cassette 9 closes the accommodation portion 23 by being fitted into the opening 23A. According to this configuration, the cassette 9 is attached to the printing device 2. On the other hand, the cassette 9 is separated from the printing device 2 by moving forward (in a direction of an arrow Y22) with respect to the printing device 2. The lid 91 of the cassette 9 is disengaged from the opening 23A, and the accommodation portion 23 is opened. Thus, the cassette 9 is removed from the printing device 2.

As illustrated in FIG. 3, on the front surface of the base plate 21, the supply unit 22A, the winding unit 22F, the attachment units 22B to 22E, the thermal head 24, the control board 25, and Hall sensors 28A and 28B (see FIG. 6) are provided. The supply unit 22A and the winding unit 22F are aligned in the horizontal direction above the center of the base plate 21 in the vertical direction. The attachment unit 22B is provided at the upper right corner of the base plate 21. The attachment unit 22C is provided at the lower right corner of the base plate 21. The attachment unit 22D is provided at the lower left corner of the base plate 21. The attachment unit 22E is provided at the upper left corner of the base plate 21. When the cassette 9 illustrated in FIG. 2 is attached to the printing device 2, the shafts 92A to 92F are connected to the supply unit 22A, the attachment units 22B to 22E, and the winding unit 22F, respectively. The supply roll 90A wound around the spool 921 of the shaft 92A is attached to the supply unit 22A. The winding roll 90B wound around the spool 922 of the shaft 92F is attached to the winding unit 22F.

Figure 5:
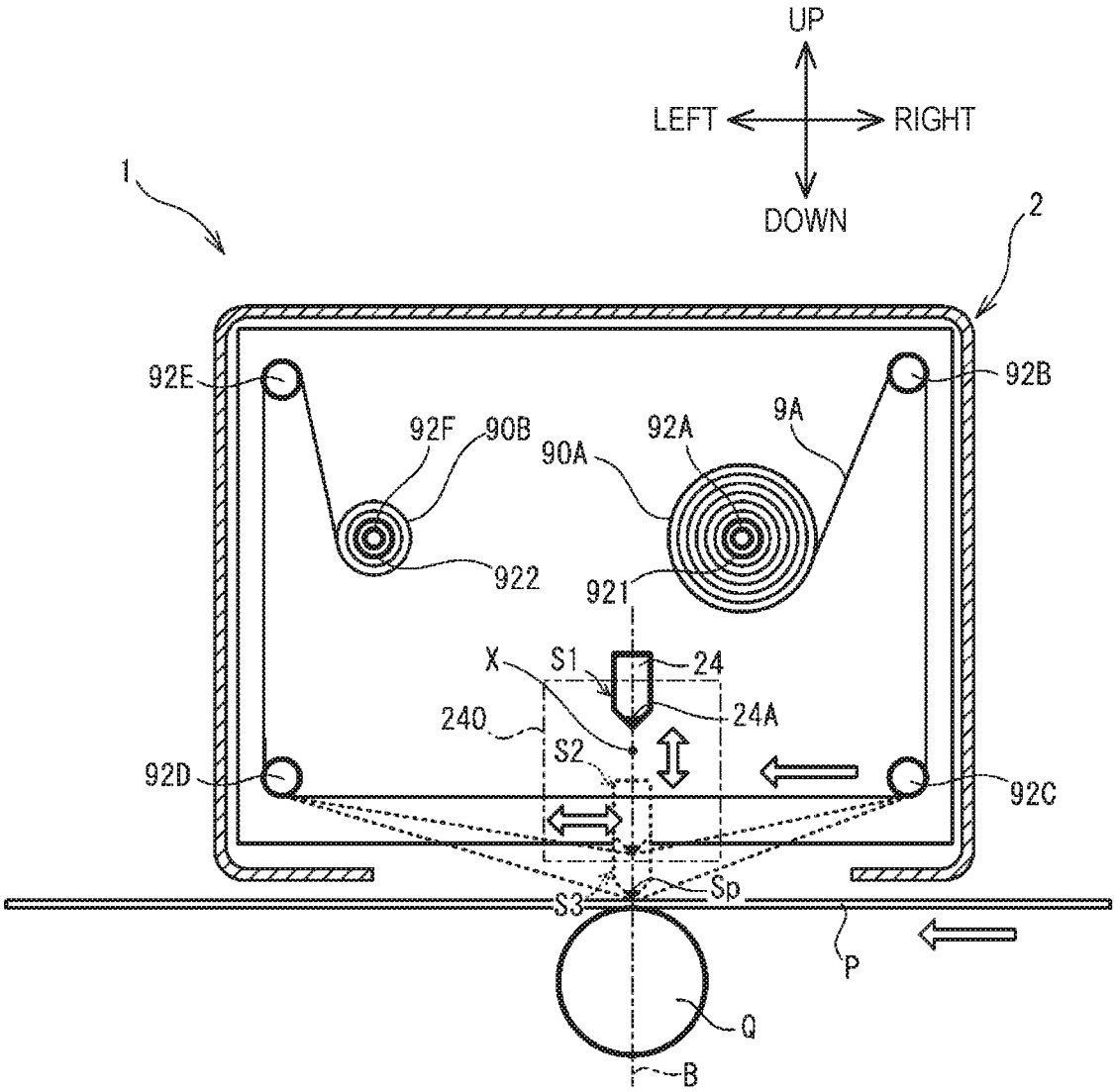
FIG. 5 is a view for explaining an operation of the printing device.
Figure 6:
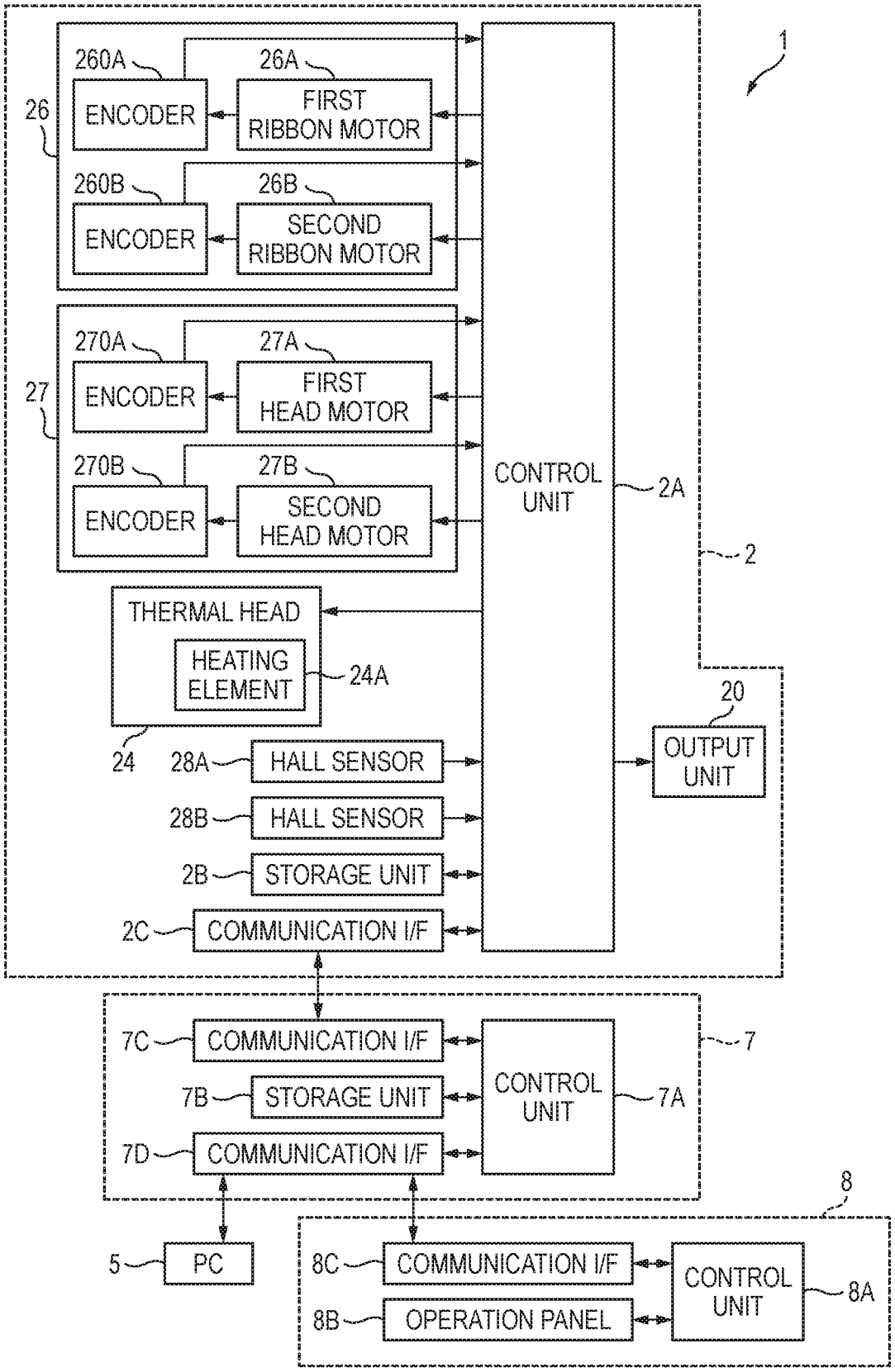
FIG. 6 is a block diagram illustrating an electrical configuration of the printing system.

The ribbon drive source 26 includes a first ribbon motor 26A and a second ribbon motor 26B (see FIG. 6). The first ribbon motor 26A and the second ribbon motor 26B are stepping motors. Respective rotation shafts of the first ribbon motor 26A and the second ribbon motor 26B protrude forward of the base plate 21. The rotation shaft of the first ribbon motor 26A is connected to the supply unit 22A. The first ribbon motor 26A rotationally drives the supply unit 22A. The rotation shaft of the second ribbon motor 26B is connected to the winding unit 22F. The second ribbon motor 26B rotationally drives the winding unit 22F. As illustrated in FIG. 5, when the supply unit 22A and the winding unit 22F rotate in a state where the cassette 9 is attached to the printing device 2, the ink ribbon 9A is transported in the printing device 2 while being guided in contact with the shafts 92B to 92E between the supply roll 90A and the winding roll 90B (see FIG. 2). Hereinafter, the moving direction of the ink ribbon 9A transported between the attachment units 22C and 22D is referred to as a "transport direction of the ink ribbon 9A".

As illustrated in FIG. 3, the thermal head 24 is provided at a lower end portion of the front surface of the base plate 21 and at a portion between the attachment units 22C and 22D. The thermal head 24 is a line thermal head having a plurality of heating elements 24A (see FIGS. 5 and 6) linearly aligned in the front-and-rear direction. As illustrated in FIG. 5, the thermal head 24 contacts a portion, which is stretched between the shafts 92C and 92D, of the ink ribbon 9A transported from the supply roll 90A toward the winding roll 90B of the cassette 9 from above. The print medium P and the ink ribbon 9A are sandwiched between the thermal head 24 and the platen roller Q disposed below the printing device 2. The thermal head 24 performs printing on the print medium P by heating the ink ribbon 9A while pressing the ink ribbon 9A against the print medium P.

As illustrated in FIG. 3, the head drive source 27 includes a first head motor 27A and a second head motor 27B (see FIG. 6). The first head motor 27A and the second head motor 27B are stepping motors. The first head motor 27A is connected to the thermal head 24 through a gear. The gear moves the thermal head 24 in the vertical direction by rotational drive of the first head motor 27A. As illustrated in FIG. 5, the thermal head 24 approaches the platen roller Q by moving downward and is separated from the platen roller Q by moving upward. The moving direction (vertical direction) of the thermal head 24 by the rotational drive of the first head motor 27A is orthogonal to the transport direction of the ink ribbon 9A.

The second head motor 27B is connected to the thermal head 24 through a pulley and a belt. The pulley and the belt move the thermal head 24 in the horizontal direction by the rotational drive of the second head motor 27B. The moving direction (horizontal direction) of the thermal head 24 by the rotational drive of the second head motor 27B is orthogonal to both an extending direction (front-and-rear direction) of the rotation axis of the platen roller Q and the moving direction (vertical direction) of the thermal head 24 by the rotational drive of the first head motor 27A and is parallel to the transport direction of the ink ribbon 9A. The thermal head 24 is movable within a rectangular range 240 by the first head motor 27A and the second head motor 27B.

The movable range 240 of the thermal head 24 will be described in detail. A virtual line extending in the vertical direction through the center of the platen roller Q and along the base plate 21 is referred to as a reference line B. The thermal head 24 is disposed at any one of a first position S1, a second position S2, and a third position S3 by moving in the vertical direction along the reference line B according to rotational drive of the first head motor 27A. The first position S1 corresponds to a position of an upper end of the range 240 among positions along the reference line B. In a state where the thermal head 24 is disposed at the first position S1, the heating element 24A is separated from the ink ribbon 9A.

The third position S3 corresponds to a position slightly above a lower end of the range 240 among positions along the reference line B. The third position S3 is the position of the thermal head 24 when the printing device 2 performs printing. A position of the heating element 24A when the thermal head 24 is disposed at the third position S3 is referred to as a "print position Sp". The print position Sp is the most protruding position upward among positions on the side surface of the platen roller Q, in other words, is a position, which is closest to the thermal head 24 disposed at the first position S1, among positions on the side surface of the platen roller Q in the moving direction (vertical direction) of the thermal head 24 by the rotational drive of the first head motor 27A.

The second position S2 is positioned slightly above the third position S3. The second position S2 is closer to the platen roller Q than the first position S1 and is farther from the platen roller Q than the third position S3. The heating element 24A contacts the ink ribbon 9A in a state where the thermal head 24 is disposed at the second position S2 and the third position S3.

As illustrated in FIG. 3, a control unit 2A and a storage unit 2B (see FIG. 6) are mounted on the control board 25. The Hall sensors 28A and 28B (see FIG. 6) are provided in the vicinity of the thermal head 24. The Hall sensors 28A and 28B detect magnetic field strength of a magnet attached to the thermal head 24, and output a signal indicating the detected magnetic field strength to the control unit 2A. The magnetic field strength detected by the Hall sensor 28A changes according to the movement of the thermal head 24 in the vertical direction. For that reason, the control unit 2A can specify the position of the thermal head 24 in the vertical direction based on the signal output from the Hall sensor 28A. The magnetic field strength detected by the Hall sensor 28B changes according to the movement of the thermal head 24 in the horizontal direction. For that reason, the control unit 2A can specify the position of the thermal head 24 in the horizontal direction based on the signal output from the Hall sensor 28B.

Bracket 6

As illustrated in FIGS. 1 and 4, the bracket 6 moves the printing device 2 in the front-and-rear direction (in a direction of an arrow Y3) orthogonal to the horizontal direction which is the transport direction of the print medium P (see FIG. 5). The bracket 6 includes a support portion 61, a bracket motor 62, a lead screw (not illustrated), and a ball screw (not illustrated). The support portion 61 has a substantially box shape that is long in the front-and-rear direction. The lead screw is disposed inside the support portion 61 and extends in the front-and-rear direction. The rear end portion of the lead screw is coupled to a rotation shaft of the bracket motor 62. The ball screw is screwed into the lead screw, and moves in the front-and-rear direction according to rotation of the lead screw. The ball screw is connected to a coupling portion 20C extending from the right end portion of the casing 20A of the printing device 2. The printing device 2 moves in the front-and-rear direction according to the movement of the ball screw in the front-and-rear direction by the rotation of the lead screw.

Controller 7

As illustrated in FIG. 6, the controller 7 is interposed between a PC 5 and the external apparatus 8 and the printing device 2. The controller 7 outputs data required for the printing device 2 to execute printing to the printing device 2. A specific example of data output from the controller 7 to the printing device 2 includes data of a print image. The controller 7 also transmits a signal output from the PC 5 and the external apparatus 8 to the printing device 2. An example of the signal output from the PC 5 includes an instruction signal for moving the thermal head 24 of the printing device 2. An example of the signal output from the PC 5 or the external apparatus 8 includes a speed signal indicating a transport speed of the print medium P. Examples of the signal output from the external apparatus 8 include a transport start signal/transport stop signal of the print medium P, and a print signal for notifying the printing time for the print medium P.

Electrical Configuration

An electrical configuration of the printing system 1 will be described with reference to FIG. 6. The printing device 2 includes the control unit 2A, the storage unit 2B, a communication interface 2C, the thermal head 24, the first ribbon motor 26A, the second ribbon motor 26B, the first head motor 27A, the second head motor 27B, the Hall sensors 28A and 28B, encoders 260A, 260B, 270A, and 270B, and an output unit 2D. The control unit 2A is electrically connected to the storage unit 2B, the communication interface 2C, the thermal head 24, the first ribbon motor 26A, the second ribbon motor 26B, the first head motor 27A, the second head motor 27B, the encoders 260A, 260B, 270A, and 270B, the Hall sensors 28A and 28B, and the output unit 2D.

The control unit 2A executes a first main processing (see FIG. 7), a second main processing (see FIG. 8), a third main processing (see FIG. 9), and a fourth main processing (see FIG. 10) by reading and executing a program stored in the storage unit 2B. The storage unit 2B stores the program for the control unit 2A to execute the first to fourth main processing. When print position setting is completed, the storage unit 2B stores setting information (hereinafter, referred to as "print position information") indicating the print position Sp. The communication interface 2C is an interface element for communicating between the printing device 2 and the controller 7. The communication interface 2C is connected to the controller 7 through a communication cable.

The thermal head 24 allows a current to be supplied to the heating element 24A according to a control signal from the control unit 2A to cause the heating element 24A to generate heat. The first ribbon motor 26A rotates according to a pulse signal output from the control unit 2A and feeds out the ink ribbon 9A from the supply roll 90A of the cassette 9. The second ribbon motor 26B rotates according to the pulse signal output from the control unit 2A, and winds the ink ribbon 9A around the winding roll 90B of the cassette 9. The first head motor 27A rotates according to the pulse signal output from the control unit 2A and moves the thermal head 24 in the vertical direction. The second head motor 27B rotates according to the pulse signal output from the control unit 2A and moves the thermal head 24 in the horizontal direction. The encoders 260A, 260B, 270A, and 270B detect rotational positions and rotation amounts of the rotation shafts of the first ribbon motor 26A, the second ribbon motor 26B, the first head motor 27A, and the second head motor 27B, respectively. Each of the encoders 260A, 260B, 270A, and 270B outputs a signal indicating the detected rotational position and rotation amount to the control unit 2A.

The Hall sensors 28A and 28B detect the magnetic field strength of the magnet attached to the thermal head 24, and output a signal indicating the detected magnetic field strength to the control unit 2A. The output unit 2D is a display unit that displays a state of the printing device 2 and the like.

The controller 7 includes a control unit 7A, a storage unit 7B, and communication interfaces 7C and 7D. The communication interface 7C is an interface element for communicating between the printing device 2 and the controller 7. The communication interface 7C is connected to the printing device 2 through a communication cable. The communication interface 7D is an interface element for communicating between a PC 5 and the external apparatus 8 and the controller 7. The communication interface 7D is connected to the PC 5 and the external apparatus 8 through a communication cable. Data required for the printing device 2 to execute printing is stored in the storage unit 7B. The control unit 7A is electrically connected to the storage unit 7B and the communication interfaces 7C and 7D. The control unit 7A reads data required for the printing device 2 to execute printing from the storage unit 7B, and outputs the data to the printing device 2 through the communication interface 7C. The control unit 7A detects a signal received from the PC 5 and the external apparatus 8 through the communication interface 7D, and outputs the signal to the printing device 2 through the communication interface 7C.

The external apparatus 8 includes a control unit 8A, an operation panel 8B, and a communication interface 8C. An instruction to the external apparatus 8 is input to the operation panel 8B. The communication interface 8C is an interface element for communicating between the external apparatus 8 and the controller 7. The communication interface 8C is connected to the controller 7 through a communication cable. The control unit 8A is electrically connected to the operation panel 8B and the communication interface 8C. The control unit 8A receives an instruction input to the operation panel 8B. The control unit 8A outputs various signals to the controller 7 through the communication interface 8C.

Overview of Print Operation

An overview of a print operation in the printing system 1 will be described with reference to FIG. 5. The thermal head 24 of the printing device 2 is disposed at the first position S1 in a state where the cassette 9 is detached. The printing device 2 rotationally drives the first head motor 27A in response to attaching of the cassette 9, and moves the thermal head 24 downward from the first position S1 to the second position S2. The controller 7 outputs data indicating the print image to the printing device 2. The printing device 2 receives the data and stores the data in the storage unit 2B.

In response to the start of transport of the print medium P by the external apparatus 8, the transport start signal for starting transport of the print medium P and the speed signal indicating the transport speed of the print medium P are output from the external apparatus 8. The printing device 2 receives the transport start signal and the speed signal through the controller 7. The printing device 2 rotationally drives the first ribbon motor 26A and the second ribbon motor 26B to rotate the supply roll 90A and the winding roll 90B so that the ink ribbon 9A is transported at a speed synchronized with the transport speed indicated by the speed signal. The ink ribbon 9A is moved to the left at a speed synchronized with the print medium P in the transport path. The ink ribbon 9A and the print medium P run in the left direction in parallel to each other.

The print signal notifying the printing time for the print medium P is repeatedly output from the external apparatus 8. The printing device 2 repeatedly receives the print signal through the controller 7. The printing device 2 rotationally drives the first head motor 27A according to reception of the print signal, and moves the thermal head 24 downward from the second position S2 to the third position S3. The thermal head 24 sandwiches the ink ribbon 9A and the print medium P with the platen roller Q, and presses the ink ribbon 9A against the print medium P. The heating element 24A of the thermal head 24 generates heat based on data stored in the storage unit 2B. Ink of the ink ribbon 9A is transferred to the print medium P, and the print image is printed. After printing the print image, the first head motor 27A is rotationally driven and the thermal head 24 is moved upward from the third position S3 to the second position S2. Printing of the print image is repeatedly performed each time the print signal is received in the printing device 2.

In order to adjust a heating position of the ink ribbon 9A in the front-and-rear direction by the thermal head 24, the bracket 6 may move the printing device in the front-and-rear direction by rotational drive of the bracket motor 62.

According to the stop of transport of the print medium P by the external apparatus 8, the transport stop signal for stopping the transport of the print medium P is output from the external apparatus 8. The printing device 2 receives the transport stop signal through the controller 7. The printing device 2 stops rotation of the first ribbon motor 26A and the second ribbon motor 26B. According to this configuration, rotation of the supply roll 90A and the winding roll 90B is also stopped, and the transport of the ink ribbon 9A is stopped.

Origin Detection Processing of Thermal Head 24

The control unit 2A of the printing device 2 executes an origin detection processing in order to detect information on an origin position X which is a reference when moving the thermal head 24 in the vertical direction by the first head motor 27A. As illustrated in FIG. 5, the origin position X is disposed between the first position S1 and the second position S2 among the positions along the reference line B. In the origin detection processing, driving conditions (hereinafter referred to as "origin position information") of the first head motor 27A in a state where the thermal head 24 is disposed at the origin position X are acquired and stored in the storage unit 2B. The control unit 2A can move the thermal head 24 from the origin position X to the first position S1, the second position S2, and the third position S3 by rotationally driving the first head motor 27A based on the origin position information stored in the storage unit 2B.

First Main Processing

Figure 7:
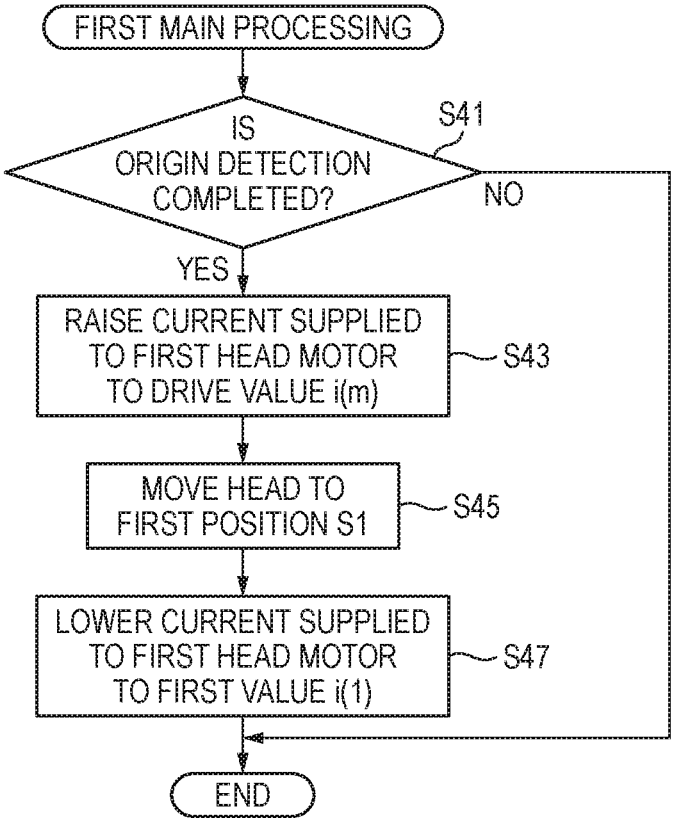
FIG. 7 is a flowchart illustrating a first main processing.

A first main processing will be described with reference to FIG. 7. The first main processing is started by the control unit 2A of the printing device 2 when the lid 91 opens the accommodation portion 23 of the casing 20A by removing the cassette 9 from the printing device 2. The control unit 2A determines whether an origin detection processing is completed (S41). When the origin position information is not stored in the storage unit 2B, the control unit 2A determines that the origin detection processing is not completed (NO in S41). In this case, since the thermal head 24 cannot be moved to a desired position, the control unit 2A ends the first main processing.

When the origin position information is stored in the storage unit 2B, the control unit 2A determines that the origin detection processing is completed (YES in S41). In this case, the control unit 2A can move the thermal head 24 to the desired position. The control unit 2A raises the current supplied to the first head motor 27A to a drive value i(m) required for the first head motor 27A to rotate (S43). The first head motor 27A is rotated by supplying the current of the drive value i(m) to move the thermal head 24 to the first position S1 (see FIG. 5) (S45). After the thermal head 24 is moved to the first position S1, the control unit 2A lowers the current supplied to the first head motor 27A to a first value i(1) smaller than the drive value i(m) (S47). According to this configuration, the rotation of the first head motor 27A is stopped, and the movement of the thermal head 24 is ended. The thermal head 24 is maintained in a state of being disposed at the first position S1. The control unit 2A ends the first main processing. By supplying the current of the first value i(1) to the first head motor 27A, first torque is generated in the first head motor 27A and the rotation thereof is suppressed. For that reason, the thermal head 24 becomes difficult to be moved from the first position S1 even if an external force is applied.

Second Main Processing

Figure 8:
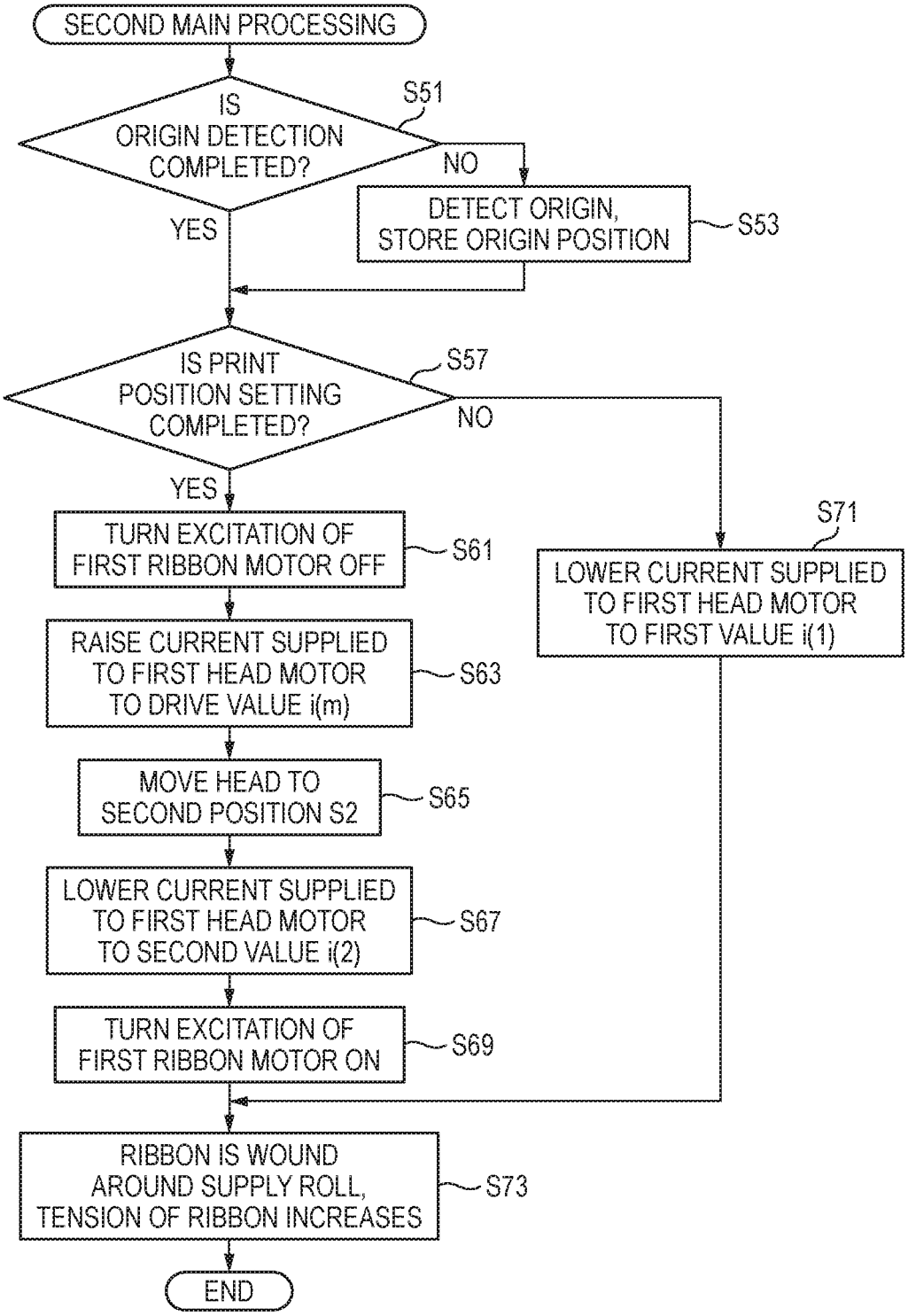
FIG. 8 is a flowchart illustrating a second main processing.

A second main processing will be described with reference to FIG. 8. The second main processing is started by the control unit 2A of the printing device 2 when the lid 91 closes the accommodation portion 23 of the casing 20A by attaching the cassette 9 to the printing device 2. The control unit 2A determines whether or not the origin detection processing is completed (S51). A method of determining whether or not the origin detection processing is completed is the same as the first main processing. When it is determined that the origin detection processing is not completed (NO in S51), the control unit 2A executes the origin detection processing (S53). The control unit 2A stores the origin position information acquired by the origin detection processing in the storage unit 2B (S53). The control unit 2A causes the processing to proceed to S57. On the other hand, when it is determined that the origin detection processing is completed (YES in S51), the control unit 2A causes the processing to proceed to S57.

The control unit 2A determines whether or not the print position setting is completed (S57). When it is determined that the print position information is not stored in the storage unit 2B (NO in S57), the control unit 2A cannot move the thermal head 24 to the third position S3 (see FIG. 5), and thus printing cannot be executed. The control unit 2A lowers the current supplied to the first head motor 27A to the first value i(1) (S71). The control unit 2A causes the processing to proceed to S73.

When it is determined that the print position information is stored in the storage unit 2B (YES in S57), the control unit 2A can execute printing by moving the thermal head 24 to the third position S3 (see FIG. 5) such that the heating element 24A is disposed at the print position Sp. The control unit 2A does not cause a current to be supplied to the first ribbon motor 26A and releases the excitation (S61). According to this configuration, the supply unit 22A and the supply roll 90A are in a freely rotatable state, and thus tension of the ink ribbon 9A decreases.

The control unit 2A raises the current supplied to the first head motor 27A to the drive value i(m) (S63). The first head motor 27A is rotated by supplying the current of the drive value i(m) to move the thermal head 24 to the second position S2 (see FIG. 5) (S65). As illustrated in FIG. 5, the heating element 24A of the thermal head 24 contacts the ink ribbon 9A. However, the excitation of the first ribbon motor 26A is released by the processing of S61, and the supply unit 22A and the supply roll 90A are in a freely rotatable state. For that reason, when the heating element 24A of the thermal head 24 contacts the ink ribbon 9A, the ink ribbon 9A is fed out from the supply roll 90A, and the tension of the ink ribbon 9A does not increase.

After the thermal head 24 is moved to the second position S2, the control unit 2A lowers the current supplied to the first head motor 27A to a second value i(2) smaller than the first value i(1) (S67). According to this configuration, the rotation of the first head motor 27A is stopped and the movement of the thermal head 24 is ended. The thermal head 24 is maintained in a state of being disposed at the second position S2. By supplying the current of the second value i(2) to the first head motor 27A, second torque is generated in the first head motor 27A and the rotation thereof is suppressed. For that reason, the thermal head 24 becomes difficult to be moved from the second position S2 even if an external force is applied. The second torque is smaller than the first torque when the current of the first value i(1) is supplied to the first head motor 27A. For that reason, the force for suppressing the movement of the thermal head 24 is larger in a state where the lid 91 of the cassette 9 opens the accommodation portion 23 of the printing device 2 than in a state where the lid 91 of the cassette 9 closes the accommodation portion 23 of the printing device 2. The control unit 2A causes the current to be supplied to the first ribbon motor 26A to excite the first ribbon motor 26A (S69). The control unit 2A causes the processing to proceed to S73.

The control unit 2A rotationally drives the first ribbon motor 26A to rotate the supply roll 90A, and causes the ink ribbon 9A to be wound around the supply roll 90A. According to this configuration, the control unit 2A increases the tension of the ink ribbon 9A (S73). For example, when the ink ribbon 9A is slackened in the transport path according to the movement of the thermal head 24 due to the processing of S65, the slackened state of the ink ribbon 9A is eliminated, and the ink ribbon 9A is in a stretched state between the shafts 92C and 92D. According to this configuration, printing can be executed according to the reception of the transport start signal and the print signal received through the communication interface 2C. The control unit 2A ends the second main processing.

Third Main Processing

Figure 9:
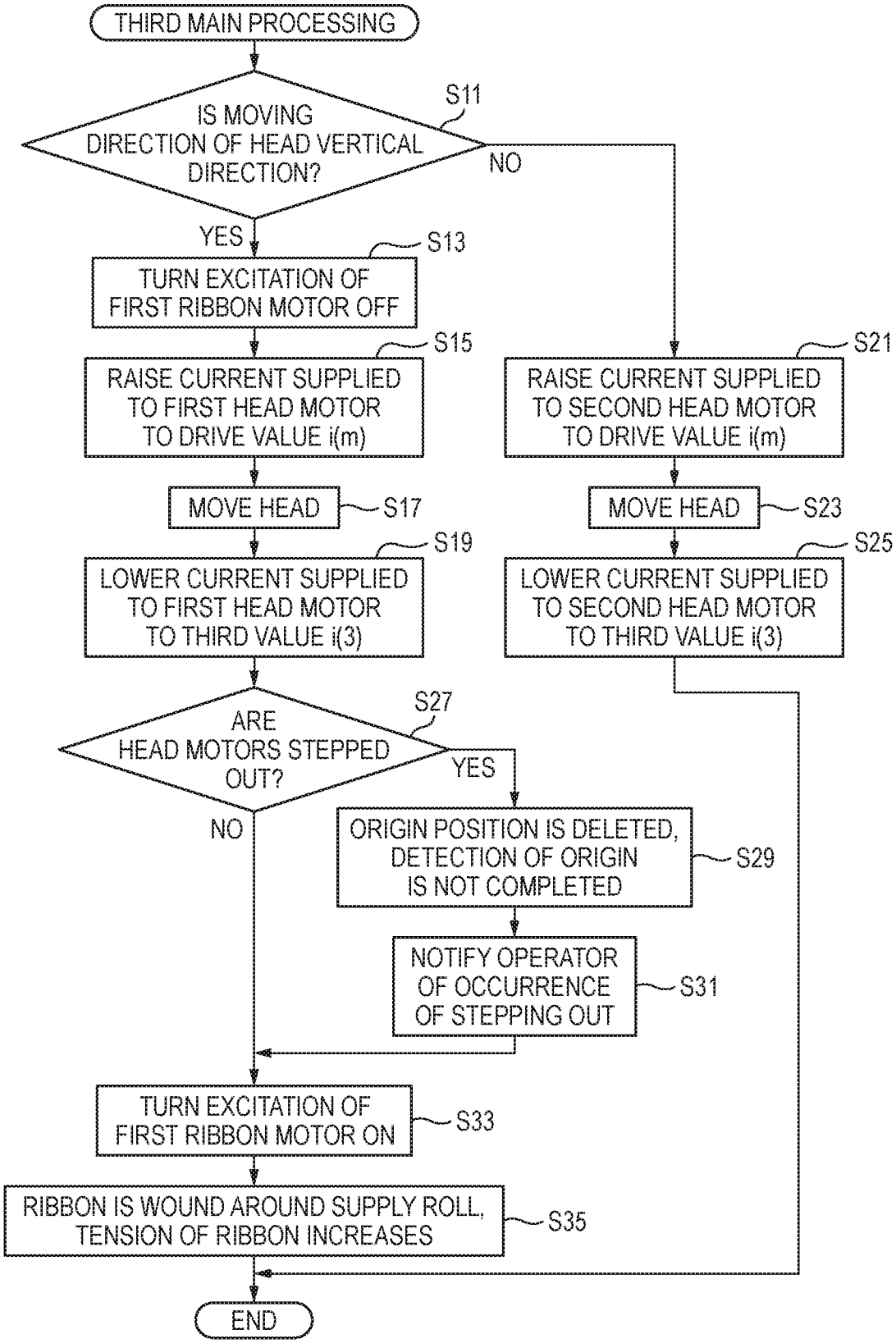
FIG. 9 is a flowchart illustrating a third main processing.

A third main processing will be described with reference to FIG. 9. When an instruction to move the thermal head 24 of the printing device 2 is input, the PC 5 outputs an instruction signal for moving the thermal head 24 to the controller 7. The control unit 2A receives the instruction signal from the controller 7 through the communication interface 2C. The control unit 2A starts the third main processing when the cassette 9 is attached to the printing device 2 and the accommodation portion 23 is closed by the lid 91. The control unit 2A determines whether or not the moving direction of the thermal head 24 instructed by the received instruction signal is the vertical direction (S11). When it is determined that the moving direction of the thermal head 24 instructed is the vertical direction (YES in S11), the control unit 2A causes the processing to proceed to S13.

The control unit 2A does not cause a current to be supplied to the first ribbon motor 26A and releases the excitation thereof (S13). According to this configuration, the supply roll 90A is in a freely rotatable state, and thus the tension of the ink ribbon 9A decreases. The control unit 2A raises the current supplied to the first head motor 27A to the drive value i(m) (S15). The first head motor 27A is rotated by supplying the current of drive value i(m) to move the thermal head 24 upward or downward to the position instructed by the instruction signal (S17). Here, for example, a case where the thermal head 24 is moved downward to the position where the heating element 24A contacts the ink ribbon 9A is exemplified. The excitation of the first ribbon motor 26A is released by the processing of S13, and the supply unit 22A and the supply roll 90A are in a freely rotatable state. For that reason, when the heating element 24A of the thermal head 24 contacts the ink ribbon 9A, the ink ribbon 9A is fed out from the supply roll 90A, and the tension of the ink ribbon 9A does not increase.

After the thermal head 24 is moved, the control unit 2A lowers the current supplied to the first head motor 27A to a third value i(3) smaller than the first value i(1) (S19). According to this configuration, the rotation of the first head motor 27A is stopped, and the movement of the thermal head 24 is ended. The thermal head 24 is maintained in a state of being disposed at the position instructed by the instruction signal. By supplying the current of the third value i(3) to the first head motor 27A, third torque is generated in the first head motor 27A and the rotation thereof is suppressed. For that reason, the thermal head 24 becomes difficult to be moved even if an external force is applied. The third torque is smaller than the first torque when the current of the first value i(1) is supplied to the first head motor 27A. The third main processing is executed in a state where the accommodation portion 23 of the printing device 2 is closed by the lid 91. For that reason, the force for suppressing the movement of the thermal head 24 is larger in a state where the lid 91 of the cassette 9 opens the accommodation portion 23 of the printing device 2 than in the state where the lid 91 of the cassette 9 closes the accommodation portion 23 of the printing device 2.

The control unit 2A determines, based on the output signals of the encoders 270A and 270B, whether or not the first head motor 27A and the second head motor 27B are stepped out by the change in tension of the ink ribbon 9A by the processing of S15 to S19 (S27). When it is determined that the first head motor 27A and the second head motor 27B are stepped out (YES in S27), the control unit 2A deletes the origin position information stored in the storage unit 2B (S29). Thus, the origin detection processing is not completed (S29). The control unit 2A drives the output unit 2D to notify an operator that the first head motor 27A and the second head motor 27B are stepped out (S31). The control unit 2A causes the processing to proceed to S33. On the other hand, when it is determined that the first head motor 27A and the second head motor 27B are not stepped out (NO in S27), the control unit 2A causes the processing to proceed to S33.

The control unit 2A causes a current to be supplied to the first ribbon motor 26A to excite the first ribbon motor 26A (S33). The control unit 2A rotationally drives the first ribbon motor 26A to rotate the supply roll 90A, and causes the ink ribbon 9A to be wound around the supply roll 90A. According to this configuration, the control unit 2A increases the tension of the ink ribbon 9A (S35). For example, when the ink ribbon 9A is slackened in the transport path according to the movement of the thermal head 24 due to the processing of S17, the slackened state of the ink ribbon 9A is eliminated, and the ink ribbon 9A is in a stretched state between the shafts 92C and 92D. According to this configuration, printing can be executed according to the reception of the transport start signal and the print signal received through the communication interface 2C. The control unit 2A ends the third main processing.

On the other hand, when it is determined that the moving direction of the thermal head 24 instructed is the horizontal direction (NO in S11), the control unit 2A raises the current supplied to the second head motor 27B to the drive value i(m) (S21). The second head motor 27B is rotated by supplying the current of the drive value i(m) to move the thermal head 24 leftward or rightward to the position instructed by the instruction signal (S23). After the thermal head 24 is moved, the control unit 2A lowers the current supplied to the second head motor 27B to the third value i(3) (S25). According to this configuration, the rotation of the second head motor 27B is stopped, and the movement of the thermal head 24 is ended. The thermal head 24 is maintained in a state of being disposed at the position instructed by the instruction signal. By supplying the current of the third value i(3) to the second head motor 27B, third torque is generated in the second head motor 27B and the rotation thereof is suppressed. For that reason, the thermal head 24 becomes difficult to be moved even if an external force is applied. The control unit 2A ends the third main processing.

Fourth Main Processing

Figure 10:
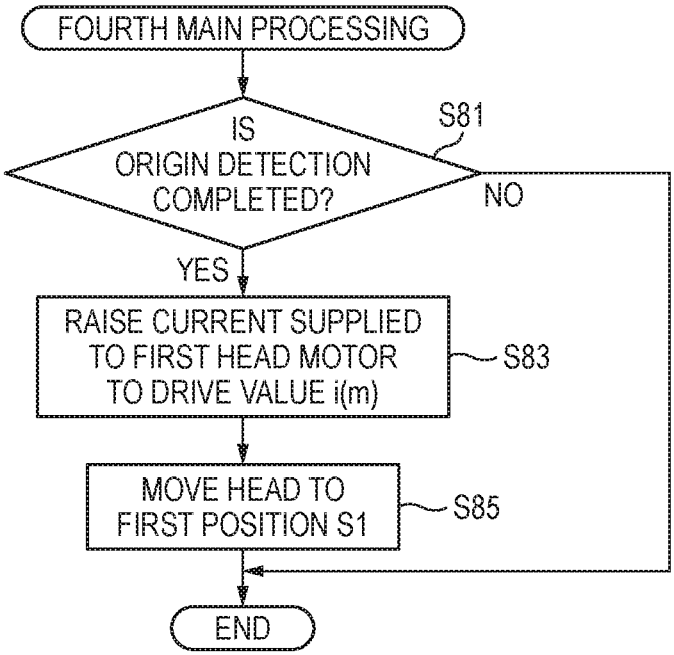
FIG. 10 is a flowchart illustrating a fourth main processing.

A fourth main processing will be described with reference to FIG. 10. The fourth main processing is started by the control unit 2A of the printing device 2 when an operation to turn the power supply of the printing device 2 off is performed. The control unit 2A determines whether or not the origin detection processing is completed (S81). The method of determining whether or not the origin detection processing is completed is the same as the first main processing and the second main processing. When it is determined that the origin detection processing is not completed (NO in S81), the control unit 2A ends the fourth main processing.

When it is determined that the origin detection processing is completed (YES in S81), the control unit 2A raises the current supplied to the first head motor 27A to the drive value i(m) (S83). The first head motor 27A is rotated by supplying the current of the drive value i(m) to move the thermal head 24 to the first position S1 (see FIG. 5) (S85). The control unit 2A ends the fourth main processing.

Operational Effect of Embodiment

The printing device 2 releases the excitation of the first ribbon motor 26A to decrease the tension of the ink ribbon 9A (S13 and S61) before moving the thermal head 24 in the direction in which the tension of the ink ribbon 9A increases (S17 and S65). According to this configuration, the printing system 1 can suppress an increase in tension of the ink ribbon 9A according to the movement of the thermal head 24. For that reason, since the printing system 1 can suppress cutting of the ink ribbon 9A due to the increase in tension and stepping out of the first ribbon motor 26A and the second ribbon motor 26B, the printing system 1 can appropriately perform printing. The printing device 2 releases the excitation of the first ribbon motor 26A (S13 and S61), and allows the supply roll 90A to be in a freely rotatable state. According to this configuration, the printing device 2 suppresses that the thermal head 24 is moved to contact the ink ribbon 9A and the tension of the ink ribbon 9A increases. For that reason, the printing system 1 can easily realize control for decreasing the tension of the ink ribbon 9A by releasing the excitation of the first ribbon motor 26A.

The thermal head 24 contacts the ink ribbon 9A in the processing of moving downward from the first position S1 to the second position S2 by rotational drive of the first head motor 27A (S65). The moving direction in this case is orthogonal to the transport direction of the ink ribbon 9A. For that reason, the printing device 2 can bring the heating element 24A into contact with the ink ribbon 9A appropriately by the movement of the thermal head 24, and transfer ink of the ink ribbon 9A to the print medium P by heat generation of the heating element 24A. The printing system 1 can suppress an increase in tension of the ink ribbon 9A when the thermal head 24 is moved from the first position S1 to the second position S2 before printing.

The printing device 2 decreases the tension of the ink ribbon 9A by releasing the excitation of the first ribbon motor 26A. By moving the thermal head 24 in a state where the excitation of the first ribbon motor 26A is released, the ink ribbon 9A is moved in a direction in which the ink ribbon 9A is fed out from the supply roll 90A that has become rotatable. When the ink ribbon 9A is moved in the direction in which the ink ribbon 9A is fed out from the winding roll 90B by the movement of the thermal head 24, a part of the ink ribbon 9A heated by the heating element 24A of the thermal head 24 may return to the position of the heating element 24A. In this case, a part of the ink ribbon 9A heated already by the heating element 24A may be heated again. In contrast, the printing system 1 can suppress the movement of the ink ribbon 9A to the supply roll 90A side due to the movement of the thermal head 24. Accordingly, the printing system 1 can reduce a possibility that the part of the ink ribbon 9A heated by the heating element 24A of the thermal head 24 returns to the position of the heating element 24A and is heated again by the heating element 24A.

When the cassette 9 is attached and the accommodation portion 23 of the casing 20 is closed by the lid 91, the printing device 2 moves the thermal head 24 from the first position S1 to the second position S2 so that printing can be executed according to the reception of the transport start signal and the print signal (S65). In order to suppress the increase in the tension of the ink ribbon 9A according to the movement of the thermal head 24 to the second position S2, the printing device 2 releases the excitation of the first ribbon motor 26A before the movement of the thermal head 24 (S61). For that reason, the printing system 1 can suppress that the ink ribbon 9A is cut at the start of printing, or that the first ribbon motor 26A and the second ribbon motor 26B are stepped out due to an increase in tension of the ink ribbon 9A.

The printing device 2 releases the excitation of the first ribbon motor 26A to decrease the tension of the ink ribbon 9A (S13, S61) and then rotationally drives the first ribbon motor 26A to cause the ink ribbon 9A to be wound around the supply roll 90A before the start of printing. According to this configuration, the printing device 2 increases the tension of the ink ribbon 9A to eliminate the slackness thereof (S35 and S73). For that reason, the printing system 1 can reduce the possibility of starting printing in a state where the ink ribbon 9A is slackened. Accordingly, since the printing system 1 can appropriately heat the ink ribbon 9A by the thermal head 24, the printing system 1 can appropriately perform printing.

After the movement of the thermal head 24 (S17 and S65), the printing device 2 supplies a current to the first head motor 27A (S19 and S67). Thus, torque is generated in the first head motor 27A, and the first head motor 27A becomes difficult to rotate. Accordingly, after moving the thermal head 24 in the direction in which the tension of the ink ribbon 9A increases, the printing system 1 can suppress the movement of the thermal head 24 from the position where the thermal head 24 is moved.

When the accommodation portion 23 of the printing device 2 is opened by the lid 91 of the cassette 9, a finger or the like of the operator easily contacts the thermal head 24, and thus the thermal head 24 is easily moved by receiving an external force at the time of contact. On the other hand, when the accommodation portion 23 of the printing device 2 is closed by the lid 91 of the cassette 9, the thermal head 24 becomes difficult to receive an external force, and thus the possibility of the thermal head 24 moved by the external force is low. In contrast, the printing device 2 supplies the current of the first value i(1) to the first head motor 27A when the accommodation portion 23 is in an open state (S47). The printing device 2 supplies the current of the second value i(2) smaller than the first value i(1) to the first head motor 27A when the accommodation portion 23 is in a closed state (S67). In this case, the first torque of the first head motor 27A when the accommodation portion 23 is opened is larger than the second torque of the first head motor 27A when the accommodation portion 23 is closed. Accordingly, the movement of the thermal head 24 is suppressed by a larger force in a state where the accommodation portion 23 is opened than in a state where the accommodation portion 23 is closed.

For that reason, the printing system 1 can effectively reduce the possibility that the thermal head 24 is moved according to the external force received from the operator when the accommodation portion 23 is opened. On the other hand, the printing system 1 can make the value of the current supplied to the first head motor 27A when the accommodation portion 23 is closed by the lid 91 smaller than that when the accommodation portion 23 is opened. Accordingly, the printing system 1 can save power by suppressing the amount of current supplied to the first head motor 27A.

When the thermal head 24 is moved according to an input operation to the PC 5, the accommodation portion 23 of the printing device 2 is closed by the lid 91, and thus the thermal head 24 becomes difficult to receive an external force, and the possibility of the thermal head 24 moved by the external force is low. In contrast, after moving the thermal head 24 according to the instruction signal output from the PC 5, the printing device 2 supplies the current of the third value i(3) smaller than the first value i(1) to the first head motor 27A. In this case, the first torque of the first head motor 27A when the accommodation portion 23 is opened is larger than the third torque of the first head motor 27A when the accommodation portion 23 is closed. Accordingly, the movement of the thermal head 24 is suppressed with a larger force in the state where the accommodation portion 23 is opened than in the state where the accommodation portion 23 is closed. In this case, the printing system 1 can make the value of the current supplied to the first head motor 27A when the accommodation portion 23 is closed by the lid 91 smaller than that when the accommodation portion 23 is opened. Accordingly, the printing system 1 can save power by suppressing the amount of current supplied to the first head motor 27A.

Modified Example

This disclosure is not limited to the embodiment described above, and various altercations may be made thereto. In the embodiment described above, the first to fourth main processing are executed by the control unit 2A of the printing device 2. In contrast, the external apparatus 8 may be included in the printing system 1. A part or all of the first to fourth main processing may be executed by the control unit 7A of the controller 7 or the control unit 8A of the external apparatus 8.

The ribbon drive source 26 may include only one of the first ribbon motor 26A and the second ribbon motor 26B. The ribbon drive source 26 may include only one motor that rotationally drives both the supply unit 22A and the winding unit 22E The control unit 2A releases the excitation of the first ribbon motor 26A (S13 and S61) before moving the thermal head 24 in the direction in which the tension of the ink ribbon 9A increases (S17 and S65). In contrast, the control unit 2A may release the excitation of the first ribbon motor 26A at the same time as moving the thermal head 24 in the direction in which the tension of the ink ribbon 9A increases. The control unit 2A may release the excitation of the first ribbon motor 26A immediately after moving the thermal head 24 in the direction in which the tension of the ink ribbon 9A increases.

The control unit 2A decreases the tension of the ink ribbon 9A by releasing the excitation of the first ribbon motor 26A. In contrast, the control unit 2A may decrease the tension of the ink ribbon 9A by releasing the excitation of the second ribbon motor 26B. Also, the excitation of both the first ribbon motor 26A and the second ribbon motor 26B may be released. For example, an electromagnetic clutch may be provided between the first ribbon motor 26A and the supply unit 22A, and between the second ribbon motor 26B and the winding unit 22F. The control unit 2A may decrease the tension of the ink ribbon 9A by disconnecting the electromagnetic clutch.

A current value of at least one of the first ribbon motor 26A and the second ribbon motor 26B may be made small until the torque by which the ink ribbon 9A can be pulled out is reached.

The tension of the ink ribbon 9A may decrease in advance by rotating at least one of the first ribbon motor 26A and the second ribbon motor 26B in advance before driving the thermal head 24.

The moving direction of the thermal head 24 by the rotational drive of the first ribbon motor 26A is not limited to the vertical direction, and the thermal head 24 may be moved in a direction inclined with respect to the vertical direction. That is, the first ribbon motor 26A may move the thermal head 24 in a direction intersecting the transport direction of the ink ribbon 9A.

When the transport start instruction output from the external apparatus 8 is received from the controller 7 through the communication interface 2C, the control unit 2A may execute S61 to S73 of the second main processing. That is, when the transport start instruction is received, the control unit 2A may suppress the increase in tension of the ink ribbon 9A by moving the thermal head 24 from the first position S1 to the second position S2 and controlling the excitation state of the first ribbon motor 26A. Even in this case, the control unit 2A can suppress the increase in tension of the ink ribbon 9A due to the movement of the thermal head 24 before the start of printing.

After moving the thermal head 24 (S17 and S65) and exciting the first ribbon motor 26A (S33 and S69), the control unit 2A may rotationally drive the second ribbon motor 26B to rotate the winding roll 90B and cause the ink ribbon 9A to be wound around the winding roll 90B before printing is started. According to this configuration, the printing device 2 may increase the tension of the ink ribbon 9A (S35 and S73).

After the movement of the thermal head 24 (S17, S45, and S65), the control unit 2A may stop supplying the current to the first head motor 27A. The second value i(2) and the third value i(3) may be the same value or different values. The third main processing is premised to be started in a state where the accommodation portion 23 of the printing device 2 is closed by the lid 91. The control unit 2A may start the third main processing when the accommodation portion 23 is in the open state, and may move the thermal head 24 according to the instruction signal. The printing device 2 may include the lid for opening and closing the accommodation portion 23 as a part of the casing 20. The cassette 9 may be attached to the printing device 2 by closing the lid of the printing device 2 after being accommodated in the accommodation portion 23.

What is claimed is:

1. A printing system, comprising:

a control unit; and a printing device including:

a supply unit configured to be attached with a supply roll configured by an ink ribbon;

a winding unit configured to be attached with a winding roll for winding the ink ribbon fed out from the supply roll;

a ribbon motor configured to rotationally drive at least one of the supply unit and the winding unit;

a thermal head configured to perform printing by heating the ink ribbon transported from the supply roll toward the winding roll by driving the ribbon motor; and a head drive source configured to move the thermal head, wherein the control unit is configured to control the ribbon motor to decrease tension of the ink ribbon before the thermal head is moved in a first direction, in which the tension of the ink ribbon increases, with the head drive source, wherein, in a case of adjusting a position of the thermal head before printing, when the thermal head is moved in the first direction, the control unit is configured to control the ribbon motor to decrease the tension of the ink ribbon, and wherein after adjusting the ribbon motor such that the tension of the ink ribbon decreases, the control unit is configured to control the ribbon motor to increase the tension of the ink ribbon until printing is started.

2. The printing system according to claim 1, wherein the control unit is configured to control the ribbon motor to release excitation to decrease the tension of the ink ribbon.

3. The printing system according to claim 1, wherein the head drive source is configured to move the thermal head in a second direction intersecting a transport direction of the ink ribbon.

4. The printing system according to claim 1, wherein the ribbon motor includes a first ribbon motor that rotationally drives the supply unit, and the control unit is configured to control the first ribbon motor to decrease the tension of the ink ribbon.

5. The printing system according to claim 1, wherein the head drive source includes a head motor for moving the thermal head by rotational drive, and the control unit is configured to control the head motor to move the thermal head in the first direction by the rotationally driving of the head motor, and the control unit is configured to control to supply a current to the head motor after the moving the thermal head in the first direction.

6. The printing system according to claim 5, wherein the printing device further includes a lid capable of opening and closing an accommodation portion in which the ink ribbon is accommodated, in response to opening of the accommodation portion, the control unit is configured to control the head drive source to move the thermal head, and the control unit is configured to control to supply a current of a first value to the head motor after the moving the thermal head with the head drive source, in response to closing of the accommodation portion by the lid, the control unit is configured to control the head drive source to move the thermal head in the first direction and the control unit is configured to control to supply a current of a second value to the head motor after the moving the thermal head in the first direction with the head drive source, and the first value is larger than the second value.

7. The printing system according to claim 5, further comprising:

an interface, which is configured to receive an operation, wherein the printing device further includes a lid capable of opening and closing an accommodation portion in which the ink ribbon is accommodated, in response to opening of the accommodation portion, the control unit is configured to control the head drive source to move the thermal head, and the control unit is configured to control to supply a current of a first value to the head motor after the moving the thermal head with the head drive source, in response to the operation received by the interface, the control unit is configured to control the head drive source to move the thermal head in the first direction with the head drive source, and the control unit is configured to control to supply a current of a third value to the head motor after the moving the thermal head in the first direction with the head drive source, and the first value is larger than the third value.

8. The printing system according to claim 1, wherein the control unit is configured to control the ribbon motor to decrease tension of the ink ribbon after a print position is set.

* * * * *